US007091709B2

(12) United States Patent
Suzuki

(10) Patent No.: US 7,091,709 B2
(45) Date of Patent: Aug. 15, 2006

(54) CONSTANT VOLTAGE POWER SUPPLY CIRCUIT

(75) Inventor: Toshio Suzuki, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/935,654

(22) Filed: Sep. 7, 2004

(65) Prior Publication Data

US 2005/0088153 A1 Apr. 28, 2005

(30) Foreign Application Priority Data

Sep. 8, 2003 (JP) ..... 2003-315249

(51) Int. Cl.
*G05F 1/56* (2006.01)

(52) U.S. Cl. ..... 323/274; 323/281

(58) Field of Classification Search ..... 323/265, 323/273, 274, 280, 281
See application file for complete search history.

(56) References Cited

U.S. PATENT DOCUMENTS 5,552,697 A * 9/1996 Chan ..... 323/282
5,557,193 A * 9/1996 Kajimoto ..... 323/282
6,373,233 B1 * 4/2002 Bakker et al. ..... 323/282

* cited by examiner

*Primary Examiner*—Gary L Laxton
(74) *Attorney, Agent, or Firm*—Robert J. Depke; Trexler, Bushnell, Giangiorgi, Blackstone & Marr, Ltd.

(57) ABSTRACT

A constant voltage power supply circuit including: a differential operation type amplifier, of which a first input terminal is supplied with a reference signal, and of which a second input terminal is supplied with a feedback signal. The amplifier outputs a first control signal responsive to a difference between the reference signal and the feedback signal. An output voltage detection circuit detects an output voltage of the output transistor and applies the detected voltage as the feedback signal to the second input terminal of the amplifier. A first capacitor of which one end is connected to the output portion of the output transistor; and a first control circuit, of which a first input terminal is connected to a first output terminal of the amplifier, of which a second input terminal is connected to another end of the first capacitor, and of which an output terminal is connected to a control input terminal of the output transistor.

14 Claims, 12 Drawing Sheets

CONSTANT VOLTAGE POWER SUPPLY CIRCUIT

The present application claims priority to Japanese Patent Application JP2003-315249, filed in the Japanese Patent Office Sep. 8, 2003; the entire contents of which is incorporated herein by reference.

BACKGROUND OF THE INVENTION

1. Field of the Invention

The present invention relates to a constant voltage power supply circuit for providing a stable voltage regardless of a load fluctuation, for example.

2. Description of the Related Art

Recently, there has been progressed a miniaturization and high-performance of a circuit such as mobile-type terminal device, and thus there has been required a miniaturization and high-performance on a power supply circuit there for.

Japanese Patent Publication (Kokai) 2000-284843 discloses a power supply circuit: a series regulator type power supply circuit for providing a stable voltage to electronic devices which are miniaturized in size and are operable at a low voltage, such as mobile-type terminal devices.

The series regulation power supply circuit disclosed in JP 2000-284843 has a stability in a low load condition, but deteriorates the PSRR (power supply rejection ratio) characteristics in a high frequency domain when the power supply voltage $V_{DD}$ is varied. Further, such the series regulator power supply circuit suffers from the disadvantages that the operation for providing a constant voltage can not followed at a high speed to the high speed load change.

Recent semiconductor devices for such as mobile-type terminal device are provided with a variety of circuits such as a communication circuit, illumination circuit, image processing circuit and data input/output circuit, and there has been strongly required a constant voltage power supply circuit enabling a provision of a stable voltage regardless of a fluctuation of loads such as those circuits.

SUMMARY OF THE INVENTION

An object of the present invention is to provide a constant voltage power supply circuit enabling a stable voltage regardless of a fluctuation of a load supplied with the constant voltage.

According to the present invention, there is provided a constant voltage power supply circuit including a differential-operation type amplifier, of which a first input terminal is supplied with a reference signal, and of which a second input terminal is supplied with a feedback signal, said amplifier outputting a first control signal responsive to a difference between the reference signal and the feedback signal; an output transistor; a output voltage detection circuit detecting an output voltage of the output transistor and applying the detected voltage as the feedback signal to the second input terminal of the amplifier; a first capacitor of which one end is connected to the output portion of the output transistor; and a first control circuit, of which a first input terminal is connected to a first output terminal of the amplifier, of which a second input terminal is connected to another end of the first capacitor, and of which an output terminal is connected to a control input terminal of the output transistor, the first control circuit generating a second control signal in response to the first control signal output from the amplifier and an output signal of the first capacitor and supplying the resultant second control signal to the control input terminal of the output transistor.

According to the present invention, there is also provided a constant voltage power supply circuit including an output-controlling transistor outputting a voltage responsive to an input control signal; and a control circuit generating the control signal responsive to the difference between the output voltage of the output-controlling transistor and the reference voltage, the control circuit including: a capacitor for feeding back the output signal, and an amplifier circuit superimposing the current responsive to the difference between the feed back voltage through the capacitor and a constant voltage, on the control signal to eliminate the fluctuation component of the output voltage.

BRIEF DESCRIPTION OF THE DRAWINGS

The above and other objects and features of the present invention will be more aparent by the following description with reference to the accompanying drawings, in which.

DESCRIPTION OF THE PREFERRED EMBODIMENTS

Figure 1:
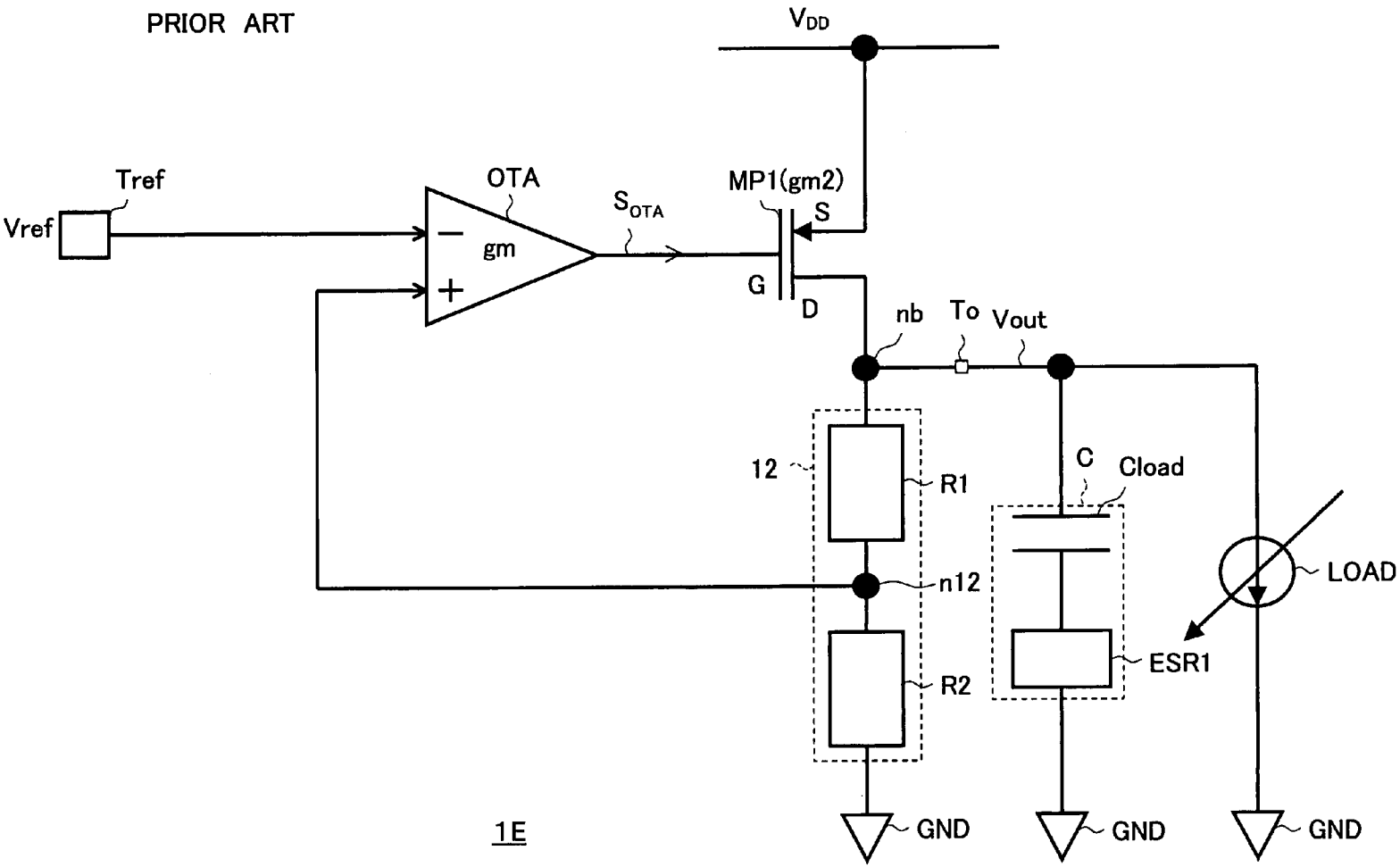
FIG. 1 is a circuit diagram of the conventional constant voltage supply circuit.

FIG. 1 is a circuit diagram of the conventional constant voltage power supply circuit.

A constant voltage power supply circuit 1*e* shown in FIG. 1 includes an operational trans-conductance amplifier: OTA as an operational amplifier circuit, a P-type MOSFET (Metal-oxide semiconductor field-effect transistor) MP1 used for an output voltage control, a voltage-deviding circuit 12 and an output capacitor (or smoothing capacitor) c.

The output voltage-controlling transistor MP1 supplies an output voltage having a voltage level corresponding to a level of a control signal input to a gate of the transistor MP1.

The transistor MP1 has a characteristic of which a conductance gm is varied in response to a value of a load at a load portion LOAD, for example.

The voltage-dividing circuit 12 has series connected resistance elements R1 and R2 and detects the output voltage of the transistor MP1.

An inverted input terminal of OTA is connected to a reference voltage terminal Tref supplying a reference voltage Vref, a non-inverted input terminal of OTA is connected to a node n12 which is a connection point of the series connected resistance elements R1 and R2, and an output terminal of the OTA is connected to the gate of the transistor MP1.

A source S of the transistor MP1 is connected to a line of a power supply voltage $V_{DD}$, and a drain D of the transistor MP1 is connected to a standard (reference) potential point GND thorough the series connected resistance elements R1 and R2, and to an output terminal To.

A reference voltage generation circuit not shown in the drawings generates the reference voltage Vref and supplies to the reference voltage terminal Tref.

The output terminal To is connected to the standard potential point GND through the output capacitor C for stablizing a regulation operation of the power supply circuit and the standard potential point GND through a load portion LOAD of which a value may be varied.

The output capacitor C includes a capacitor Cload which is a capacitive component and an equivalent series resistor ESRI which is a resistance component, and the capacitor Cload and the equivalent series resistor ESRI are seris-connected between the output terminal To and the standard potential point GND.

The OTA receives two input voltages at the inverted and non-inverted input terminals and outputs a current having an amplitude proportional to a difference between the two input voltages. Namely, the OTA outputs a control signal $S_{OTA}$ which makes to equalize the reference voltage Vref and the voltage at the node n12. The transistor MP1 supplies a stable voltage to the output terminal To in response to the control signal $S_{OTA}$ from the OTA and the power supply voltage $V_{DD}$.

In detail, the OTA outputs the control signal $S_{OTA}$ responsive to the voltage difference between the reference voltage Vref applied from the reference voltage terminal Tref and the voltage at the node n12 which is a common connected point of the series-connected resistor elements R1 and R2, to the gate G of the transistor MP1.

Namely, the OTA controls to output the output voltage Vout at the output terminal To, as defined by the following equation (1).

$$Vout = Vref \times \{(R1+R3)/R2\} \quad (1)$$

In the above constant voltage supply circuit 1*e*, since the P-type MOS transistor MP1 is used as an output stage of the constant voltage supply circuit 1*e*, the constant voltage supply circuit 1*e* can afford to output a voltage which is slightly dropped to the power supply voltage $V_{DD}$. However, since the conductance gm of the transistor MP1 may be varied in response to the fluactuation of the load of the load portion LOAD, it is difficult to achieve a phase compensation.

In addition, the constant voltage power supply circuit 1*e* includes substansive three step amplifiers formed by the OTA and the transistor MP1, the level of the output voltage would be unstable.

Further, compared with a constant voltage power supply circuit in which an N-type MOS transistor is used as an output stage, the constant voltage power supply 1*e* shows a low transient response (performance) to a high speed load fluctuation.

First Embodiment

A first embodiment will be described with reference to FIG. 2 to FIGS. 4A and 4B.

Figure 2:
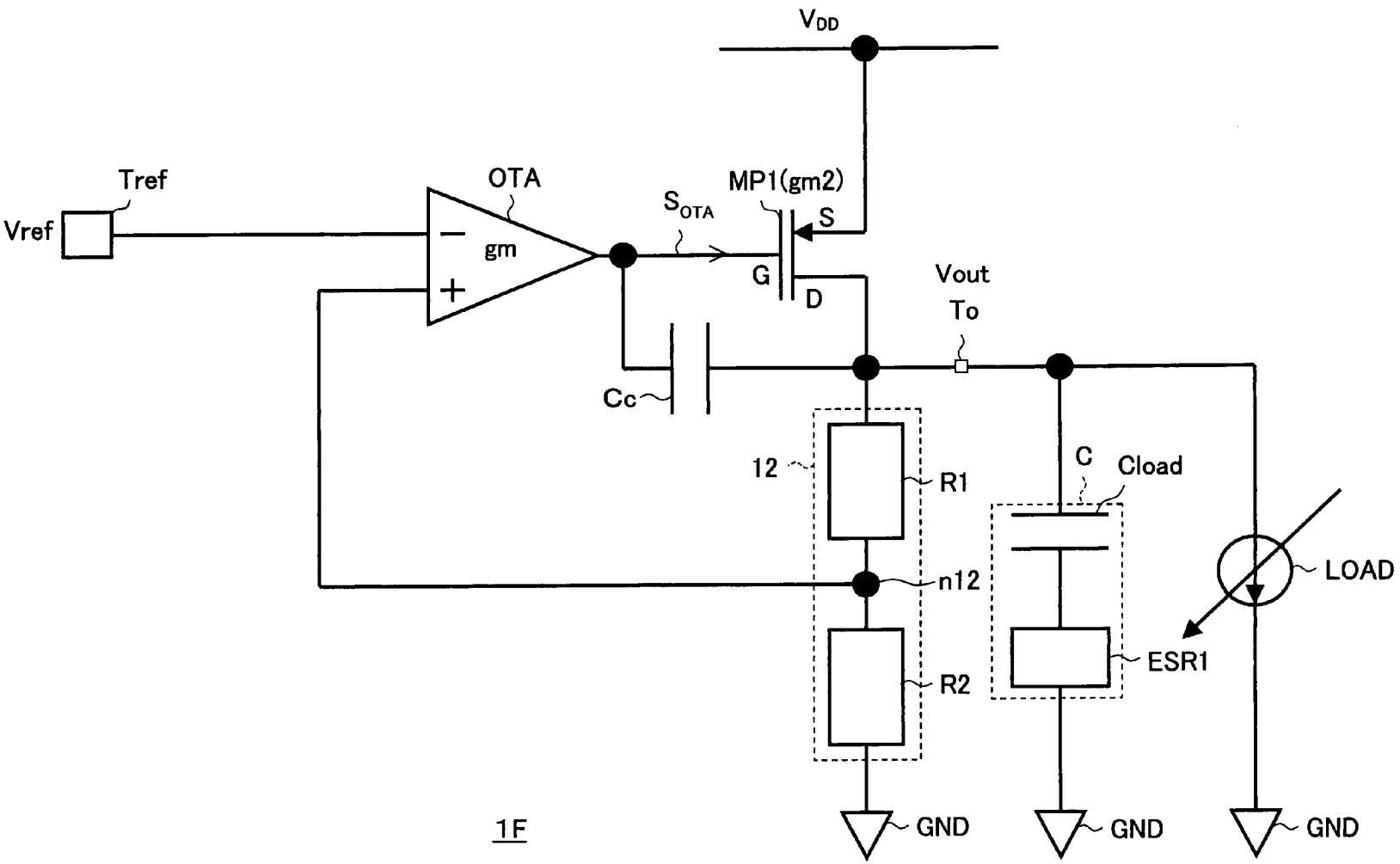
FIG. 2 is a circuit diagram of a constant voltage supply circuit of a first embodiment.

FIG. 2 is a circuit diagram showing a constant voltage supply circuit of a first embodiment of the present invention.

The difference between the constant voltage supply curcuit 1*e* in FIG. 1 and the constant voltage supply circuit 1*f* in FIG. 2 is the provision of a capacitor Cc for compensating a phase in the constant voltage supply circuit 1*f* in FIG. 2. Specifically, one terminal of the phase-compansating capacitor Cc is connected to the output terminal of the OTA and the gate G of the transistor MP1, and another terminal thereof is connected to the drain D of the transistor MP1.

It is supposed that, for the phase compansation, per se, the constant voltage supply circuit has a sufficient phase margin by a pole separation using a mirror compensation of the output transistor MP1, but it suffers from the disadvantages described later.

Figures 3A, 3B:
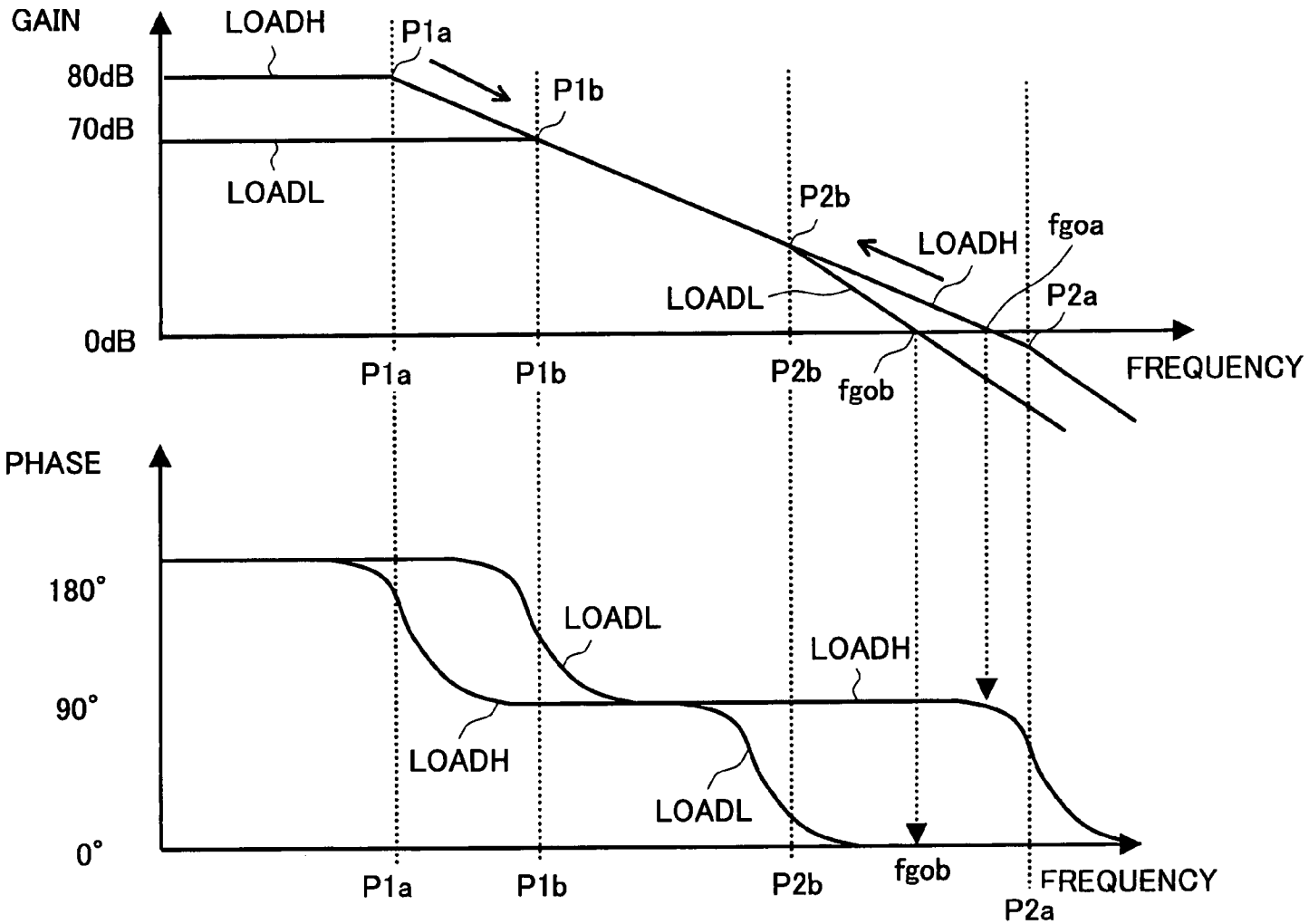
FIGS. 3A and 3B are graphs showing the gain-frequency characteristic and the phase-frequency characteristic of the constant voltage supply circuit shown in FIG. 2.

FIG. 3A is a graph showing a gain-frequency characteristic of the constant voltage supply circuit 1*f* shown in FIG. 2, and FIG. 3A is a graph showing a phase-frequency characteristic of the constant voltage supply circuit 1*f*. In FIGS. 3A and 3B, an abscissa indicates a frequency in a loganthm scale, an ordinale in FIG. 3A indicates a gain in a logarithm scale and an ordinate in FIG. 3B indicates a phase in a normal scale.

Referring to FIGS. 3A and 3B, when the load portion LOAD is a high load LOADH, the gain of the constant voltage supply circuit in approximately constant, specifically approximately 80 dB, and the phase is approximately 180 degree. The phase means a phase difference between an input signal and an output signal in a feedback system (loop).

At the frequency P1*a* there is a first pole, at the approximately frequency P1*a* the phase decreases from 180 degree to 90 degree, between the frequencies P1*a* and P2*a* the phase is approximately 90 degree and the gain decreases at a first predetermind rate (dB/Dec), specifically −20 dB/Dec, and at the frequency fgoa the gain is 1 (0 dB). Here, dB indicates a deci-Bell, and Dec indicates a Decade which is 10 times of a frequency band.

When the load of the load portion LOAD is a low load LOADL, since the output transistor MP1 may operate in a sub-threshold region (domain, or range), the gain of the output transistor MP1 may be reduced. Specifically, as shown in FIGS. 3A and 3B, between the frequencies 0 to P1*b* the gain is a constant lower than that of the high load status, for example 70 dB, and the phase is 180 degree; The first pole is moved from the frequency P1*a* to the frequency P1*b* higher than the frequency P1*a*, at the approximately frequency P1*b* the phase decreases from 180 degree to 90 degree, and between the frequencies P1*b* and P2*b* the gain is reduced at the approximately first predetermined value (dB/Dec). At the frequency P2*b* lower than the frequency P2*a* there is a second pole, and at the approximately frequency P2*b* the phase is reduced from 90 degree to 0 degree. In the frequency higher than the frequency P2*b*, the gain decreases at a third predetermined value (dB/Dec) lower than the first predetermined value (dB/Dec), and at the frequency fgob the gain is 1 (0 dB).

As described above, the constant voltage supply circuit 1*f* does not show the mirror effect when the load portion LOAD is a no-load condition or a low load condition, and thus the phase margin is small to result in a unstable status. Namely, when the phase in the high frequency domain is 0 degree, the constant voltage supply circuit becomes in a positive-feedback status, the gain exceeds 1 to thereby become the adversely oscillation status.

Figures 4A, 4B:
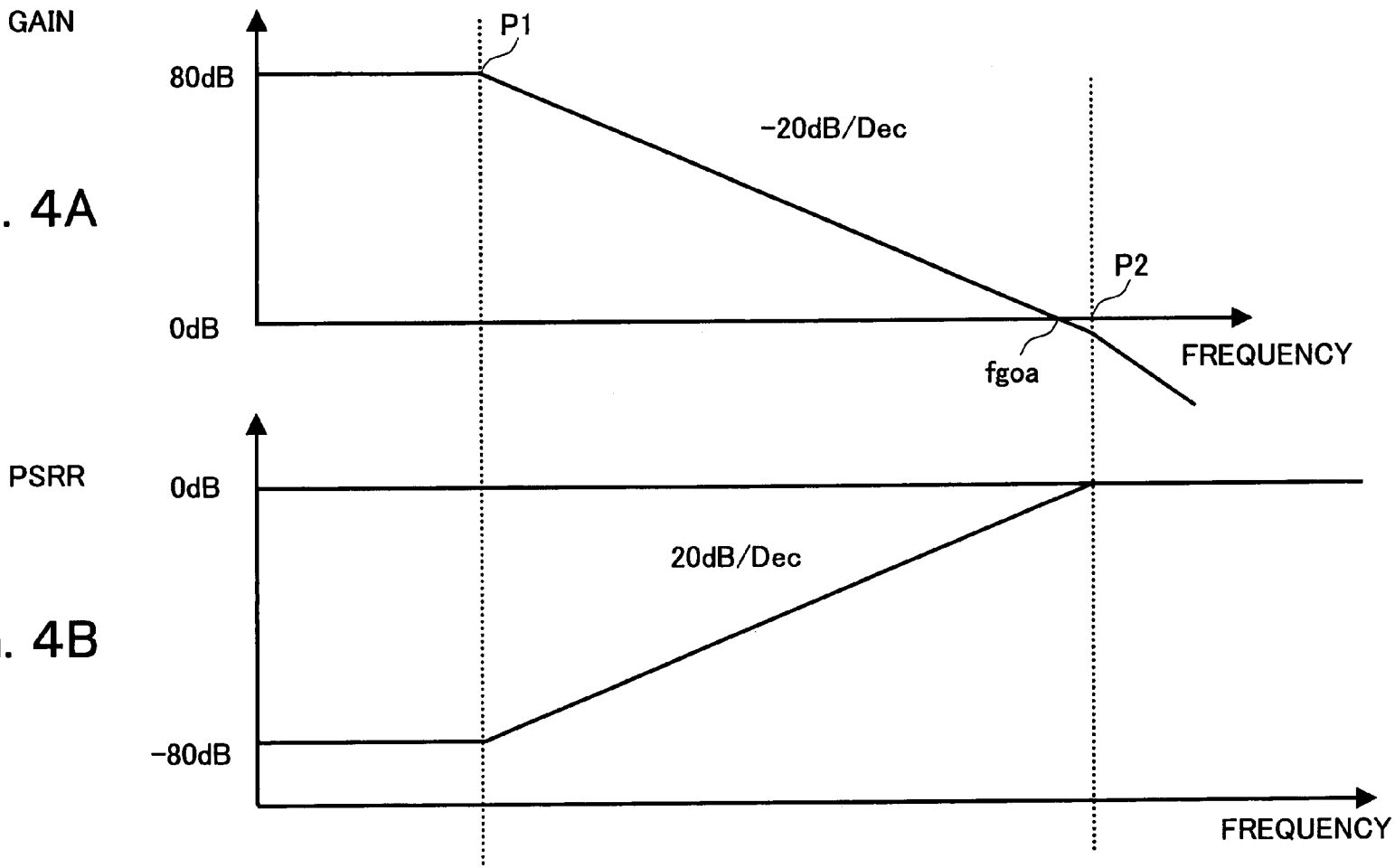
FIGS. 4A and 4B are graphs showing the gain-frequency characteristic and the PSRR (power supply rejection ratio)-frequency characteristic of the constant voltage supply circuit shown in FIG. 2.

FIG. 4A is a graph showing the characteristic between a gain and a frequency of the constant voltage supply circuit shown in FIG. 2. FIG. 4B is a graph showing the characteristic between a power supply rejection ratio: PSRR and the frequency of the constant voltage supply circuit shown in FIG. 2.

In the constant voltage supply circuit 1*f* the output voltage $V_{OUT}$ at the output terminal To is defined on the basis of the standard potential GND, and the voltage at the gate of the output transistor MP1 is defined on the basis of the power supply voltage $V_{DD}$.

Since the phase-compansating capacitor Cc shown in FIG. 2 is connected between the gate of the output transistor MP1 and the output terminal To, when the level of the power supply voltage $V_{DD}$ is varied or fluctuated, in the high frequency domain, the voltage fluctuation component adversely affects the level change of the output voltage $V_{out}$ at the output terminal To. As a result, the PSSR is deteriorated. The PSSR represents a value of a ratio of the raise or reduction of the output voltage due to the change of the poewr supply voltage $V_{DD}$.

Specifically, as shown in FIGS. 4A and 4B, in the range between the frequency 0 to P1, the gain is a constant, for example, 80 dB, and the PSSR is constant, for example, −80 dB. In the range between the frequency P1 of the first pole and the frequency P2 of the second pole, the gain decreases at a constant ratio, for example, −20 dB/Dec and the PSRR increases at a constant ratio, for example, +20 dB/Dec, and at the frequency P2 of the second pole the PSRR reaches 0 dB. As discussed above, in the constant voltage supply circuit 1*f* of the present embodiment, the PSRR is greatly deteriorated from the frequency P1 of the first pole to the high frequency band.

Second Embodiment

A second embodiment of a constant voltage supply circuit of the present invention will be described with reference to FIG. 5.

Figure 5:
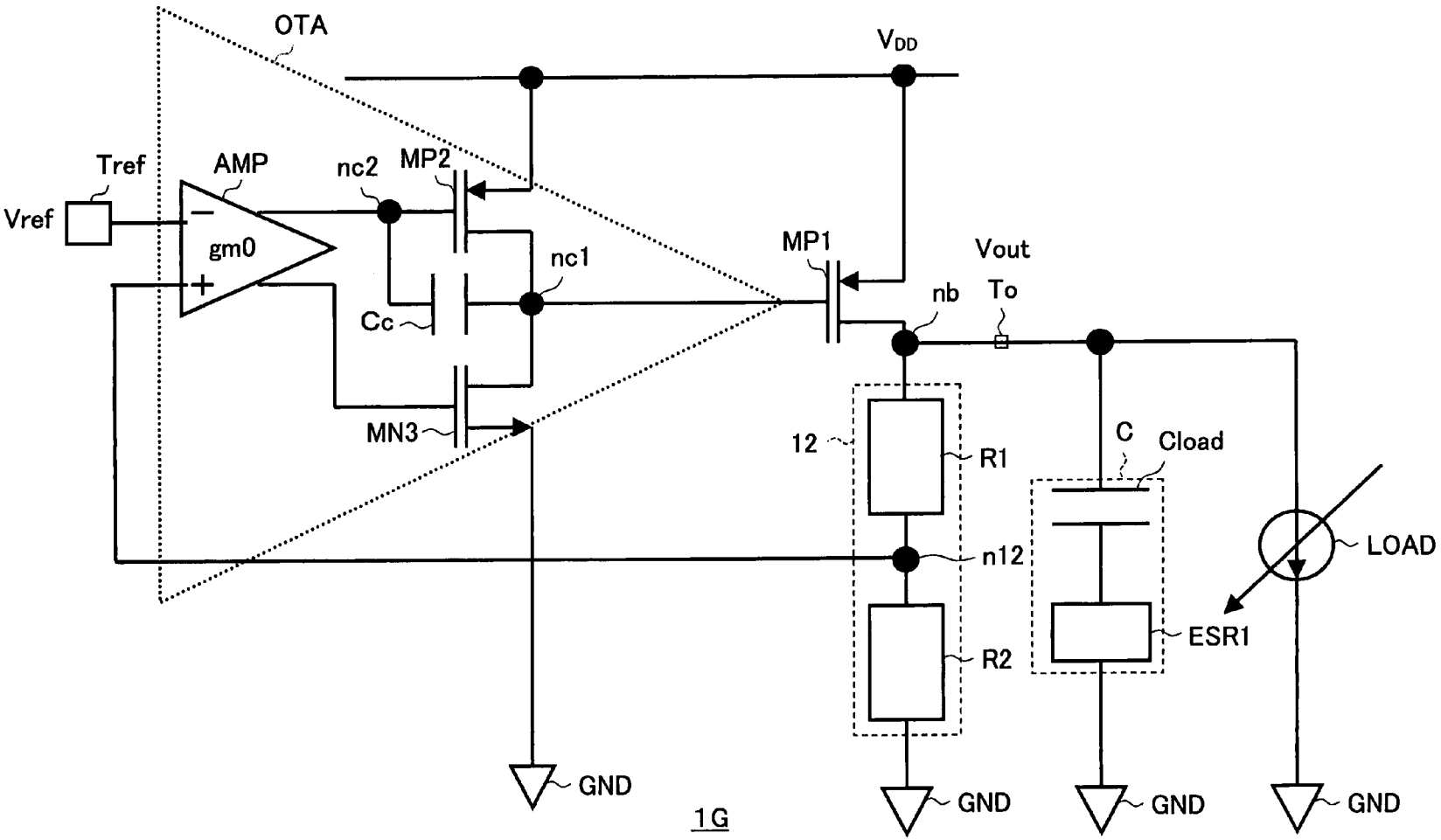
FIG. 5 is a circuit diagram of a constant voltage supply circuit of a second embodiment.

The difference between the constant voltage supply circuit 1*e* and shown in FIG. 1 and the constant voltage supply circuit 1*g* shown in FIG. 5 is the provision of a phase compensation means performing the mirror compensation to the OTA (operational trans-conductance amplifier) in the constant voltage supply circuit 1*g* shown in FIG. 5. Only the differences will be described and the description of components having the same functions will be omitted.

The constant voltage supply circuit 1*g* shown in FIG. 5 has an OTA (operational trans-conductance amplifier) including an amplifier AMP, a P-type MOSFET transistor MP2, an N-type MOSFET transistor MN3, and a phase-compensating capacitor $C_C$.

The amplifier AMP is a differential-operation type amplifier circuit, an inverted input terminal thereof is connected to the reference voltage terminal Tref, and a non-inverted input terminal thereof is connected to the node n12 in the resistance element 12. The amplifier AMP has two output terminals, one output terminal of which is connected to a gate of the transistor MP2 and the phase-compensating capacitor $C_C$, and another output terminal of which is connected to a gate of the transistor MN3.

A source of the transistor MP2 is connected to the line of the power supply voltage $V_{DD}$ and a drain thereof is connected to a drain of the transistor MN3 and the gate of the transistor MP1.

A source of the transistor MN3 is connected to the standard potential point GND.

A terminal of the phase-compensating capacitor $C_C$ is connected to the gate of the transistor MP2, and another terminal is connected to the drain of the transistor MP2, the drain of the transistor MN3 and the gate of the transistor MP1.

In the constant voltage power supply circuit 1*g* of FIG. 5, the phase-compensating capacitor $C_C$ provided in the OTA performs the mirror compensation, and the phase-compensating capacitor $C_C$ of which two terminals are connected to the nodes nc1 and nc2 of which potential depends on the ground potential GND, reduces the fluctuation of the output voltage due to the fluctuation of the power supply voltage $V_{DD}$. As s result, the constant voltage power supply circuit 1*g* will overcome the above advantages of the fluctuation of the output voltage due to the fluctuation of the power supply voltage $V_{DD}$ supplied to the constant voltage power supply circuit 1*g*, encountered in the above constant voltage power supply circuits 1*e* and 1*f*.

The constant voltage power supply circuit 1*g*, however, suffers from the disadvantage that the feedback loop including the phase-compensating capacitor $C_C$ does not work at a high speed when the load portion LOAD transiently fluctuates at a high speed. The analysis is as follows: in the constant voltage power supply circuit 1*f* shown in FIG. 2, the phase-compensating capacitor $C_C$ is connected to the output terminal $T_0$, however, in the constant voltage power supply circuit 1*g* shown in FIG. 5, the phase-compensating capacitor $C_C$ is not connected to the output terminal $T_0$, as a result, when the load of the load portion LOAD is varied at a high speed and the resultant output voltage Vout at the output terminal $T_0$ is also varied at a high speed, the constant voltage power supply circuit 1*g* cannot follow such the high speed load change and cannot provide a stable output voltage to the output terminal $T_0$.

Third Embodiment

A third embodiment of a constant voltage power circuit according to the present invention will be described with reference to FIG. 6 to FIGS. 9A and 9B.

Figure 6:
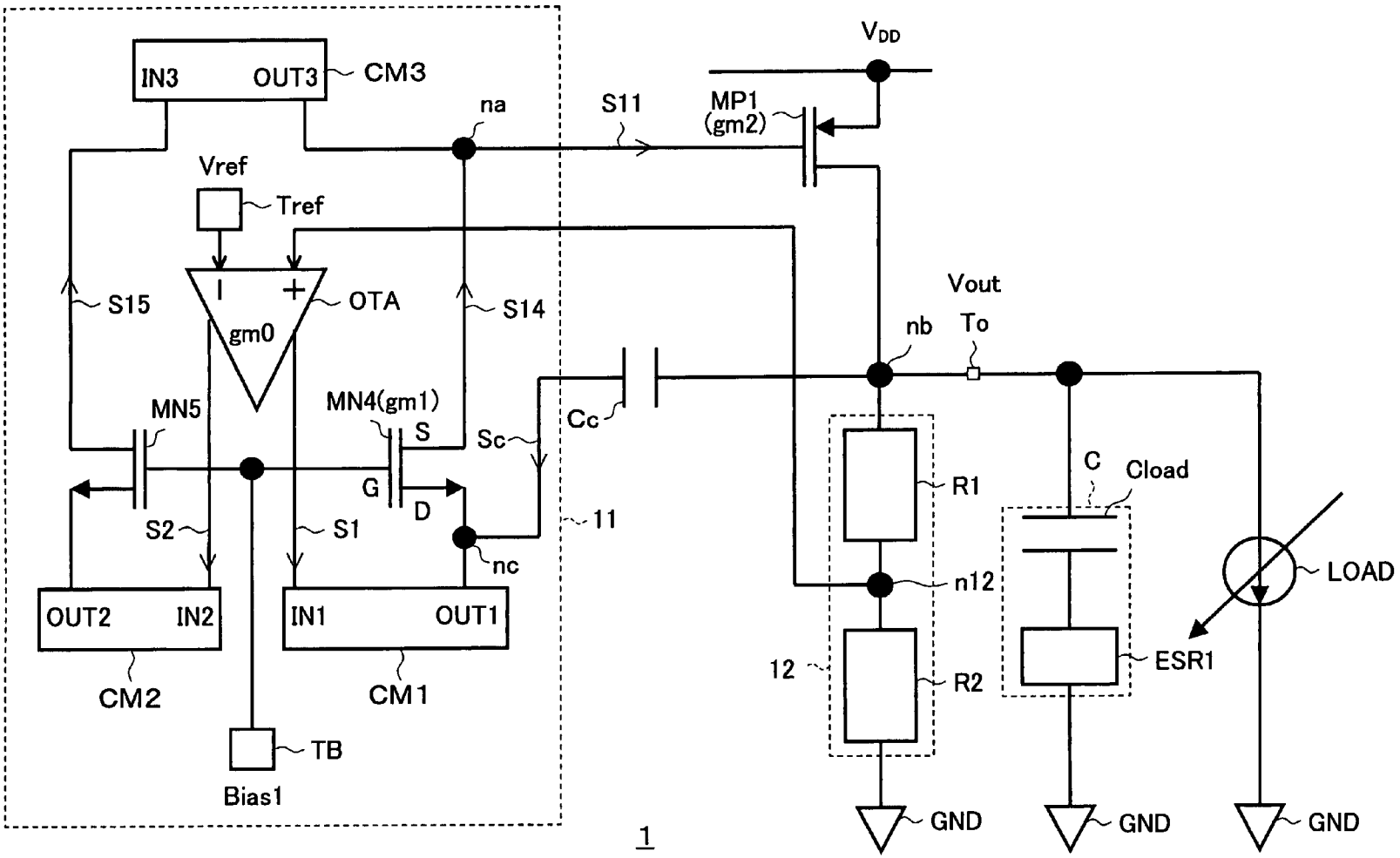
FIG. 6 is a circuit diagram of a constant voltage supply circuit of a third embodiment.

The constant voltage power supply circuit 1 shown in FIG. 6 is called as a low drop-out regulator (regulation circuit) and includes an output controlling transistor MP1 of a P-type MOSFET, an operational amplifier circuit 11, a voltage-dividing circuit 12, a phase-compensating capacitor $C_C$, and an output capacitor C.

The operational amplifier circuit 11 includes an operational trans-conductance amplifier (OTA), current mirror circuits CM1 to CM3, an N-type MOSFET transistor MN4, and an N-type MOSFET transistor MN5. The transistors MN4 and MN5 are optional, however, to improve an offset, a gain, etc., the provision of these transistors are preferable.

The voltage-dividing circuit 12 includes series connected resistor elements R1 and R2.

The output capacitor C includes a capacitive-element Cload and an equivalent resistance element ESR1, and functions as s smoothing capacitor.

Preferably, the output-controlling transistor MP1 of the P-type MOSFET, the operational amplifier circuit 11, the voltage-dividing circuit 12 and the phase-compensating capacitor $C_C$ are integrated on a semiconductor substrate as an integrated circuit (IC).

An inverted input terminal of the OTA is connected to the reference voltage terminal Tref, and a non-inverted input Terminal thereof is connected to the node n12 between the series-connected resistance elements R1 and R2 in the voltage-dividing circuit 12.

The OTA has two output terminals, one of which is connected to an input terminal IN1 of the current mirror circuit CM1 and another of which is connected to an input terminal In2 of the current mirror circuit CM2.

An output terminal OUT1 of the current mirror circuit CH1 is connected to a source of the transistor MN4 through the node $n_c$. A drain of the transistor MN4 is connected to a gate of the transistor MP1 through the node $n_a$.

An output terminal OUT2 of the current mirror circuit CM2 is connected to a source of the transistor MN5. A gate of the transistor MN5 is connected to the gate of the transistor MN4 and a bias voltage terminal TB to which a bias voltage Bias is applied. The drain of the transistor MN5 is connected to an input terminal IN3 of the current mirror circuit CM3, an output terminal OUT3 of the current mirror circuit CM3 is connected to the gate of the transistor MP1. The source of the transistor MP1 is connected to the line of the power supply voltage $V_{DD}$.

The drain of the P-type MOS transistor MP1 is connected to the output terminal $T_0$ through the node nb and the standard potential point GND through the voltage-dividing circuit 12. Specifically, an end of the resistance element R1 in the voltage-dividing circuit 12 is connected to the drain of the P-type MOS transistor MP1, another end of the resistance element R1 is connected to an end of the resistance element R1 through the node n12, and another end of the resistance element R2 is connected to the standard potential point GND.

Between the drain of the P-type MOS transistor MP1 and the source of the N-type MOS transistor MN4, the phase-compensating capacitor $C_c$ is connected. The potential levels of the both nodes nb and nc have levels depending upon the ground level GND.

The standard potential GND is supplied to the output terminal $T_0$ through the output capacitor C for stabilizing the regulation operation, and is also supplied to the output terminal $T_0$ through the load portion LOAD which may be varied its load.

The output-controlling transistor MP1 outputs an output voltage stabilized in response to a control signal S11, which is generated at the operational amplifier circuit 11. In detail, the OTA as the first amplifier circuit generates control signals S1 and S2 in response to a voltage difference between the reference voltage Vref and the output voltage Vout which is divided the output voltage of the output-controlling transistor MP1 by the voltage-dividing circuit 12. More specifically, the OTA outputs a current having an amplitude corresponding to a difference between two input voltages of the OTA. The OTA controls to provide the output voltage Vout at the output terminal $T_0$ as defined as equation (1).

The current mirror circuit CM1 performs a current amplification for a current which is an input control signal S1 at a predetermined current amplification ratio and outputs an amplified current to the source of the transistor MN4. The current mirror circuit CM2 also performs a current amplification for a current which is an input control signal S2 at a predetermined current amplification ratio and outputs the amplified current to the source of the transistor MN5.

The transistors MN4 and MN4 generate the control signal S11 for eliminating the fluctuation components in the output voltage in response to the control signals S1 and S2 generated at the OTA and input through the current mirror circuits CM1 and CM2 and the fluctuation component (signal Sc) of the output voltage Vout of the output-controlling transistor MP1 and input through the phase-compensating capacitor $C_c$.

Specifically, the transistor MN4 operates as a gate grounded circuit in which the gate is connected to the bias terminal TB, is cascade-connected to the current mirror circuit CM1, amplifies the control signal S1 input through the current mirror circuit CM1 in response to (based on) the fluctuation component of the output voltage Vout of the output-controlling transistor MP1, input through the phase-compensating capacitor $C_c$, and output the resultant signal S14 from the drain to the gate of the transistor MP1 through the node na. Also, the transistor MN5 operates as a gate grounded circuit in which the gate is connected to the bias terminal TB, is cascade-connected to the current mirror circuit CM2, amplifies the control signal S2 input through the current mirror circuit CM2, and output the resultant signal S15 from the drain to the current mirror circuit CM3. The current mirror circuit CM3 performs a current amplification for the signal S15 in a predetermined amplification ratio and outputs the resultant current to the gate of the transistor MP1 through the node na.

Preferably, the output currents of the current mirror circuits CM1 to CM3 are free from the frequencies of the input signals and the voltages at the output terminals.

The signal S11 which is added the signals S14 and S15 at the node na is input to the gate of the output-controlling transistor MP1.

The fluctuation component due to the change of the load is input to the transistor MN4 through the feedback loop including the phase-compensating capacitor $C_c$.

The load fluctuation characteristic of the constant voltage power supply circuit 1 greatly depends on the capacitance value of the capacitive element Cload of the output (smoothing) capacitor C, and thus, a large capacitance value of the capacitive element Cload is preferable, but due to the limitation of a cost, a mounting space (area), etc, the capacitance value of the capacitive element Cload is determined at a suitable value.

The AC characteristic of the constant voltage supply circuit 1 will be described. Such the AC characteristic may be expressed as a transfer function expressed by 3rd order or more higher order polynominals, but can be simply expressed by the following equations 2 and 3.

$$\text{GAIN}=A/\{(1+s/P1)\times(1+s/P2)\} \quad (2)$$

where GAIN is a gain of the AC characteristic's,
A is a DC gain,
P1 is the frequency at the first pole,
P2 is the Frequency at the second pole, and
s is an operator.

$$A=(gm_0\times R_0\mathbf{0})\times(gm_1\times R_0\mathbf{1})\times(gm_2\times R_0\mathbf{2}) \quad (3)$$

where, $gm_0$ is the conductance of the OTA,
$gm_1$ is the conductance of the transistor MN4,
$gm_2$ is the conductance of the output-controlling transistor MP1,
$R_0\mathbf{0}$ is the AC output impedance at the output of the OTA,
$R_0\mathbf{1}$ is the AC output impedance at the output of the transistor MN4, and
$R_0\mathbf{2}$ is the AC output impedance at the output of the transistor MP1.

With respect to the above fomula, see David A. Johns & Ken Martin, Analog integrated circuit Design, chapter 5, and R. Jacob Bakar Harry W. Li, David E. Boyce, CMOS circuit Design, Simulation chapter 25.

The frequency P1 of the first pole and the frequency P2 of the second pole can be expressed as a function of the capacitance value of the phase-compensating capacitor Cc. Specifically, the frequency P1 of the first pole which is a main pole is anti-proportional to the capacitance value of the phase-compansating capacitor Cc, whereas the frequency P2 of the second pole is proportional to the capacitance value of the phase-compansating capacitor Cc.

The capacitance value of the output capacitor C affects the frequency P2 of the second pole, and the equivalent series resistor ESRI forms a zero point, however, these parameters are omitted for simplification of the description.

As descussed above, in the constant voltage supply circuit 1, the capacitance value of the phase-compensating capacitor Cc is set (designed) to obtain a sufficient phase margin.

The mirror capacitance value Cca by the phase-compensating capacitor Cc is expressed as the following equation 4.

$$Cca=\{(gm_1\times R_0\mathbf{1})\times(gm_2\times R_0\mathbf{2})\times Cc \quad (4)$$

The mirror capacitance value Ccb in the constant voltage supply circuit 1*f* shown in FIG. 2 is expressed as the following equation 5.

$$Ccb=(gm_2\times R_0\mathbf{2})\times Cc \quad (5)$$

Compared with equations 4 and 5, in equation 4, the term ($gm_1\times R_0\mathbf{1}$) is multiplied to the term ($gm_2\times R_0\mathbf{2}$), and thus the mirror capacitance value in the constant voltage supply circuit 1 is large even if the capacitance value of the phase-compensating capacitor Cc is small.

The operation of the constant voltage supply circuit 1 when the load of the load portion LOAD is low or when no load will be described.

In the constant voltage supply circuit 1, the trans-conductance gm2 and the output impedance $R_0\mathbf{2}$ of the output-controlling transistor MP1, the trans-conductance $gm_1$ and the output impedance $R_0\mathbf{1}$ of the transistor MN4 and the capacitance value of the phase-compensating capacitor Cc are set so that the mirror capacitance value exceeds a predetermined value when low load or no-load, to obtain a sufficient phase margin.

Specifically, when the load of the load portion LORD is low, the trans-conductance $gm_2$ of the output-controlling transistor MP1 becomes very small. In this way, when the load is small in the constant voltage supply circuit 1*f* shown in FIG. 2, the mirror capacitive value Ccb becomes very small as indicated by equation 5, it is insufficient as the mirror capacitance value. On the other hand, in the constant voltage supply circuit 1 shown in FIG. 6, as indicated by equation 4, if the trans-conductance $gm_1$ of the transistor MN4 is large, it is sufficient as the mirror capacitive value. Therefore, in the constant voltage supply circuit 1 shown in FIG. 6, it is preferable that the trans-conductance $gm_1$ of the transistor MN4 and the AC output impedance $R_0\mathbf{1}$ of the transistor MP1 are set large to satisfy the mirror capacitive value.

Figures 7A, 7B:
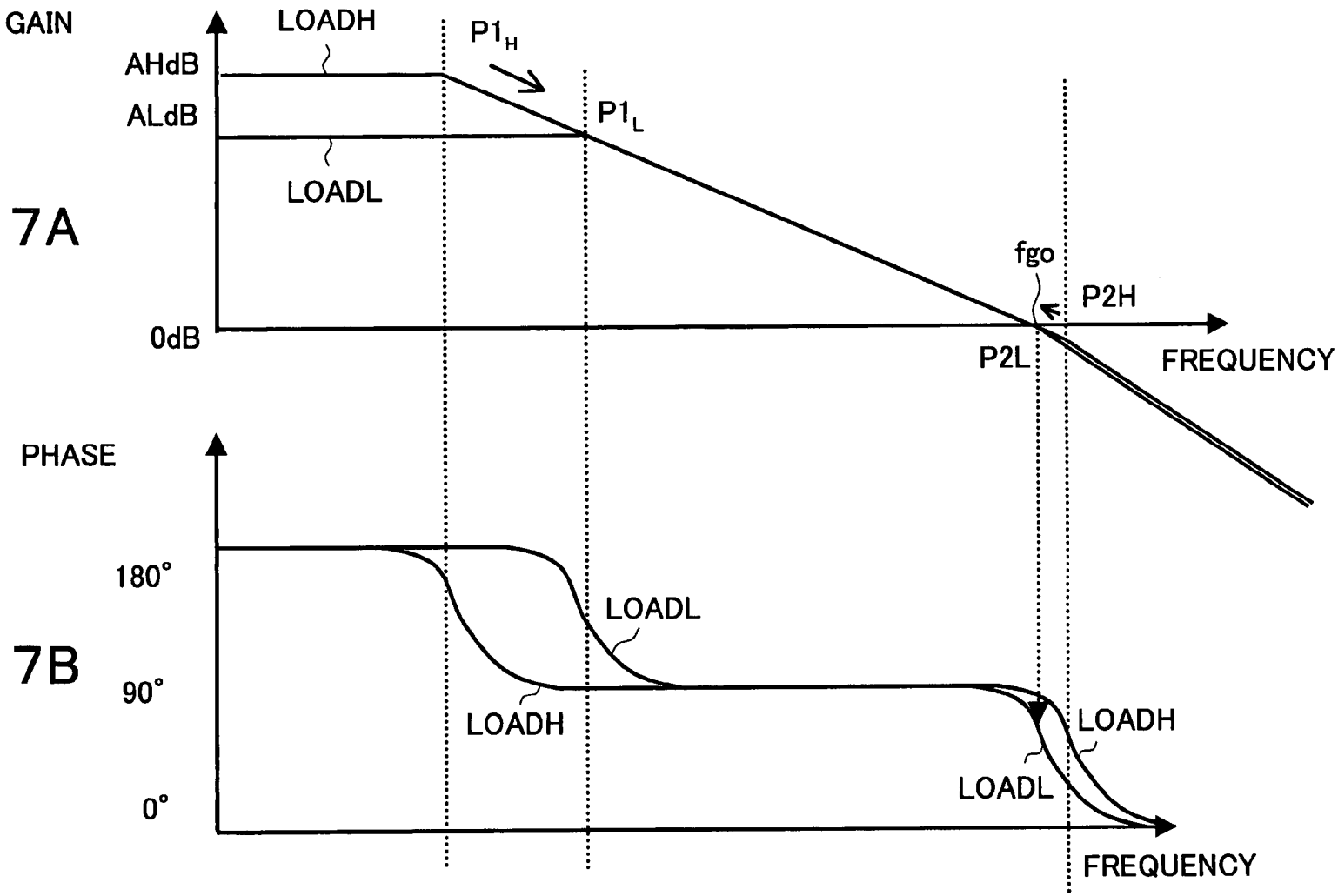
FIGS. 7A and 7B are graphs showing the gain-frequency characteristic and the phase-frequency characteristic of the constant voltage supply circuit shown in FIG. 6.

FIG. 7A is a graph showing the gain-frequency characteristic of the constant voltage supply circuit 1 shown in FIG. 6, and FIG. 7B is a graph showing the phase-frequency characteristic of the constant voltage supply circuit 1 shown in FIG. 6. In FIGS. 7A and 7B, the abscissa indicates the frequency in a logarithm scale. In FIG. 7A, the ordinate indicates the gain in a logarithm scale, and in FIG. 7B, the ordinate indicates the phase in a normal scale.

Refferring to FIGS. 7A and 7B, the pole separation of the constant voltage supply circuit 1 will be described.

In general, the frequency P2 of the second pole is proportional to the mirror capacitive value Cca, then, when the load is low (LOADH) or no load, the trans-conductance gm2 of the output-controlling transistor MP1 is reduced and the frequency P2 may be shifted to the low frequency side. For example, in the constant voltage supply circuit 1*f* shown in FIG. 2, the mirror capacitive value Ccb is very low when the load is low (LOADL), such the mirror capacitive value Ccb can not function as the mirror capacitive value. As a result, as shown in FIG. 3A, the frequency P2 of the second pole is rapidly shifted to the low frequency side. This status means that the pole separation can not be done, the phase margin is less or small and the constant voltage supply circuit 1*f* may adversely oscillate.

In the constant voltage supply circuit 1 shown in FIG. 6, when the load is low (LOADL) or no load, the frequency P2 of the second pole becomes low and the mirror capacitive value becomes small, but, in equation 4, by setting the ($gm_1\times R_0\mathbf{1}$) to sufficiently large, the mirror capacitive value Cca becomes sufficient large for functioning as the mirror capacitive element. Namely, the pole separation is achieved, and the phase margin is kept at a sufficiently large.

When the load portion LOAD is a high load condition, LOADH, in the range between the frequency 0 to the frequency $P\mathbf{1}_H$ the gain is approximately constant AH (dB) and, the phase is 180 degree. At the frequency $P^1$ there is the first pole, at the approximately frequency $P\mathbf{1}_H$ the phase decreases from 180 degree to 90 degree, in the range between the frequency $P\mathbf{1}_H$ and $P\mathbf{2}_H$ the phase is approximately 90 degree and the gain decreases a first predetermined ratio (dB/Dec), and at the frequency fgo the gain is 1 (0 dB). At the frequency $P^2H$ there is the second pole, and at approximately $P^2H$ the phase decreases 90 degree to 0 degree.

When the load portion LOAD is no load or low load (LOADL), in the range between the frequency 0 and the frequency $P\mathbf{1}_L$ the gain is constant AL (dB) lower than that AH (dB) when high load (LOADH), and the phase is 180 degree. The first pole is shifted from the frequency $P\mathbf{1}_H$ to the frequency $P\mathbf{1}_L$ higher than $P\mathbf{1}_H$, at the approximately frequency $P\mathbf{1}_L$ the phase decreases 180 degree to 90 degree. In the range between the frequencies $P\mathbf{1}_L$ and $P\mathbf{2}_L$ the gain decreases at the approximately first predetermined ratio (dB/Dec). In the frequency $P\mathbf{2}_L$ lower than the frequency $P\mathbf{2}_H$ there is the second pole, at the approximately frequency $P\mathbf{2}_L$ the phase decreases 90 degree to 0 degree. At the frequency higher than the frequency $P\mathbf{2}_L$, the gain decreases at the third predetermined ratio (dB/Dec) larger than the first predetermined ratio (dB/Dec).

Comparing FIGS. 3A and 3B and FIFs. 7A and 7B, the constant voltage supply circuit 1 shown in FIG. 6 is improved on the following points to the constant voltage supply circuit 1*f* shown in FIG. 2: when the load portion LOAD is low (LOADL) or no load, the shift of the frequency P2 of the second pole is small, there is obtained the large mirror capacitive value and thus it ensure the sufficient phase margin to prevent the oscillation at the high frequency domain. Namely, the constant voltage supply circuit 1 shiwn in FIG. 6 is improved the frequency characteristics.

Figures 8A, 8B:
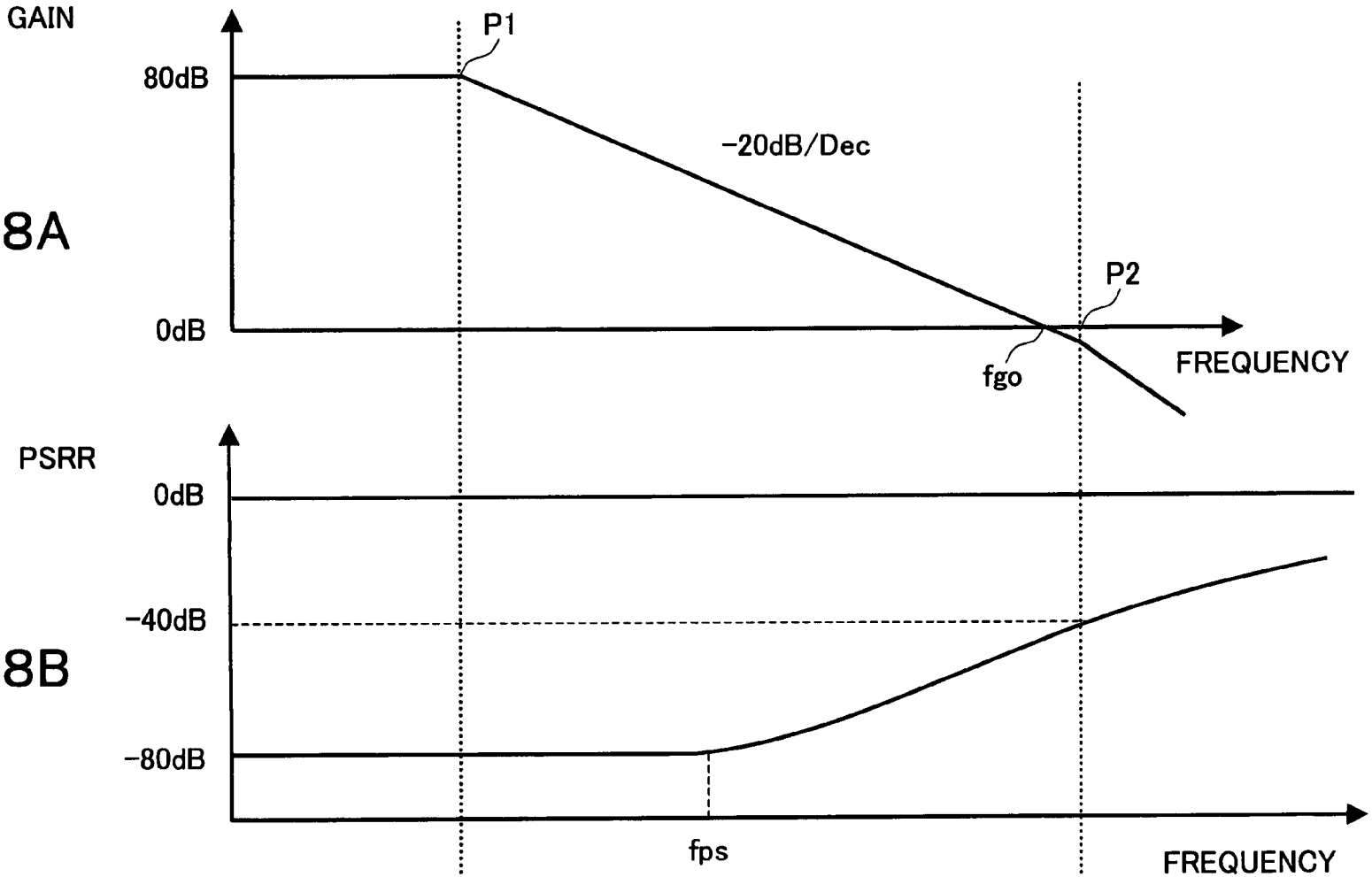
FIGS. 8A and 8B are graphs showing the gain-frequency characteristic and the PSRR-frequency characteristic of the constant voltage supply circuit shown in FIG. 6.

FIGS. 8A and 8B are graph showing the gain-frequency characteristic and the PSRR-frequency characteristic of the constant voltage supply circuit 1 shown in FIG. 6.

As discussed above, in the constant voltage supply circuit 1*f* shown in FIG. 2, the feedback loop including the phase-compensating capacitor Cc is formed to carry out the feedback operation from the output terminal To of which potential is based on the ground base to the gate of the output-controlling transistor MP1 of which potential is based on the power supply voltage $V_{DD}$, and thus, if the power supply voltage $V_{DD}$ is varied, the capacitive value of the capacitor Cc may function as a high-pass filter, to deteriorate the PSRR.

On the other hand, in the constant voltage supply circuit 1 shown in FIG. 6, the potential at the output terminal depends on the ground potential, the destination of the feedback loop including the phase-compensating capacitor Cc is the source of the transistor MN4 which forms the cascode circuit, and the gate od the transistor MN4 is supplied with the ground level voltage GND. As a result, the potentials of the nodes nb abd nc which are the destinations of the phase-compensating capacitor Cc are based on the ground potential GND. The PSRR characteristic of the constant voltage power supply circuit 1 is good over the high frequency domain, as shown in FIG. 8B, to the PSRR characteristic of the constant voltage supply circuit 1*f* shown in FIG. 2, as shown in FIG. 4B. Specifically, in the constant voltage supply circuit 1 shown in FIG. 6, as shown in FIG. 8B, the PSRR is constant, −80 dB in the range between the frequencies 0 to P1 of the first pole, and still approximately constant, −80 dB to the frequency fps high than the frequency P1 and lower than the frequency P2 of the second pole. The PSRR is raised at the frequency domain higher than the frequency fps, is a value lower than 0 dB, −40 dB, and is further raised at the high frequency domain higher than the above frequency. In this way, the PSRR characteristic is improved in the constant voltage supply circuit 1 shown in FIG. 6.

The operation of the constant voltage supply circuit 1 when the load of the load portion LOAD is varied will be described with reference to FIGS. 9A and 9B.

Figures 9A, 9B:
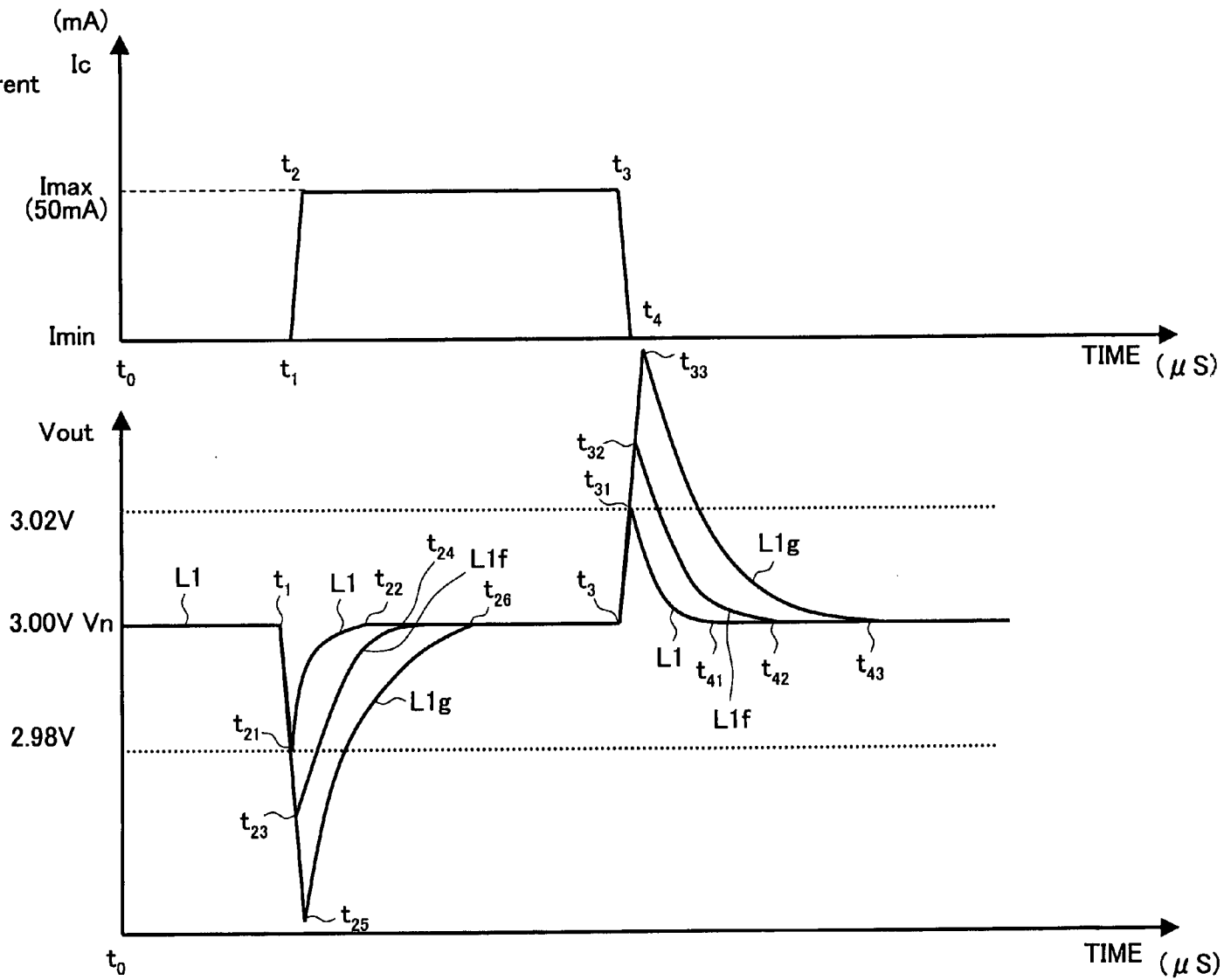
FIGS. 9A and 9B are graphs showing the output current change and the output voltage change in the constant voltage supply circuit shown in FIG. 6.

FIGS. 9A and 9B are graphs showing the change of the output current and the change of the output voltage when the load of the load portion LOAD is varied.

Note, when the load of the load portion LOAD is varied, the equation of the AC characteristic does not stand, and the operation of the constant voltage supply circuit 1 shown in FIG. 6 will be described in a qualitative manner.

When the load is not changed during the times t0 and t1, the constant voltage supply curcuit 1 supplies the constant set voltage Vn, 3.00 (V), for example, to the load portion LOAD, as shown by the voltage curve L1 shown in FIG. 9B, and outputs the current Ic. of the minimum current Imin shown in FIG. 9A.

When the load is varied during the times t1 and t2, the output current Ic is rapidly changed from the minimum current Imin to the maxmum current Imax, 50 mA, for example, the high frequency signal due to the rapid change is input to the transistor MN4 cascode-connected to the phase-compensating capacitor Cc through the phase-compensating capacitor Cc. As a result, the gate voltage of the transistor MN4 is changed due to the change of the output voltage. At this time, the N-type MS transistor MN4 operates as the gate grounded circuit, amplifies the signal S1 in response to that signal Sc and inputs the resultant signal to the node na, i.e. the gate of the output-controlling transistor MP1. As a result, the feedback loop formed by the node nb, the phase-compensating capacitor Cc, the N-type MOS transistor MN4, the node na, and the P-type MOS transistor MP1, amplifies that signal Sc at a high speed and eliminates the fluctuation of the output voltage Vout.

During the times t1 and t2, the output voltage Vout is reduced from Vn=3.00 V to 2.98 V during the times t1 to t21, and then the output voltage Vout is rapidly raised to the voltage Vn during the times t21 and t22, as shown in the voltage curve L1 shown in FIG. 9B.

During the times t2 and t3, the output current Ic is the maximum current Imax, 50 mA, for example.

During the times t3 and t4, the output current Ic is reduced from the maximum current Imax to the minimum current Imin, due to the load change. The high frequency signal Sc due to the load change is input to the N-type MOS transistor MN4 cascode-connected to the phase-compensating capacitor Cc through the phase-compensating capacitor Cc. As a result, the gate voltage of the transistor MN4 is varied in response to the change of the output voltage, the N-type MOS transistor NM4 oprtates as the gate grounded circuit, and amplifies that signal Sc at a high speed. The feedback loop including the node na, i.e. the gate of the P-type MOS transistor MP1 amplifies that signal Sc at a high speed and eliminates the voltage change. The output voltage Vout is rasised from the Vn=3.00 V to 3.02 V during the times t3 and t31, and is reduced to the voltage Vn at a high speed during the times t31 and t41.

In the constant voltage supply circuit 1*f* shown in FIG. 2 the fluctuation signal due to the change of the load of the load portion LOAD is input to the gate of the output-controlling transistor MP1 through the phase-compensating capacitor Cc, and the range of the variation of the output voltage is broad because the trans-conductance gm2 of the output-controlling transistor MP1 is small when the load is low or no load. Also, since the amplification is not carried out by the cascode circuit, the output voltage variation characteristic deteriorates. In the constant voltage supply circuit 1*f* shown in FIG. 2, as shown by the voltage curve L1*f* in FIG. 9B, during the times t1 and t23 the output voltage is reduced from the voltage Vn=3.00 V to approximately 2.97 V, during the times t23 and t24 the output voltage is slowly returned to the voltage Vn. After that, due to the change of the output current during the times t3 and t4, the output voltage Vout is raised from the voltage Vn=3.00 V to approximately 3.03 V during the times t3 and t32, and the output voltage Vout is returned to the set voltage Vn.

In the constant voltage supply circuit 1*g* shown in FIG. 5, since there is not provided the feedback loop including the phase-compensating capacitor Cc, for feedback the output voltage Vout of the output terminal To, the output voltage variation characteristic is low as shown in the voltage curve L1*g* as shown in FIG. 9B. Specifically, due to the change of the output current during the times t1 and t2, the output voltage is reduced from the set voltage Vn=3.00 V to approximately 2.95 V during the times t1 and t25, and slowly returned to the set voltage Vn diring the times t25 vand t26. After that, due to the change of the output current during the times t3 and t4, the output voltage Vout is raised from the set voltage Vn=3.00 V to approximately 3.05 V during the times t3 and t33, and slowly returned to the set voltage Vn during the times t33 and t43.

Summarizing the features of the constant voltage supply circuit 1 shown in FIG. 6 is as follows:

(1) There is provided the P-type MOSFET output-controlling transistor MP1 for supplying a stablized output voltage Vout responsive to the control signal S11 input the gate thereof, the voltage-dividing circuit 12 dividing the output voltage of the coutput-controlling transistor MP1 for producing the feedback signal, and the operational amplifier 11 for producing the control signal S11. The operational amplifier 11 includes the operational trans-conductance amplifier (OTA) for producing the control signals S1 and S2 responsive to the voltage difference between the reference voltage Vref and the voltage which is produced by dividing the output voltage of the power-controlling transistor MP1 at the voltage-dividing circuit 12, the MOSFET transistor MN4 which functions as the gate grounded circuit, is cascode-connected to the OTA and amplifies the control signal S1 input from the OTA in response to the fluctuation component, i.e. the signal Sc of the output voltage of the output-controlling transistor MP1 which is input through the phase-compensating capacitor Cc for carrying out the mirror phase compensation, and the transistor MN5 for generating the signal S15 from the control signal S2 input from the OTA. The signals S14 and S15 are added at the node na to generate the control signal S11 for eliminating the fluctuation component of the output voltage Vout and input to the gate of the output-controlling transistor MP1. According, the constant voltage supply circuit 1 supplies a stable output voltage Vout regardless of the load change.

(2) The mirror phase compensation by the capacitor Cc is carried out from the output terminal To to the node nc of which potential is based on the ground potential level and is cascade-connected in the operational amplifier 11, to achieve the phase compensation together with the pole separation to the circuit. Therefore, the output voltage Vout is stabilized at a high speed even in the power supply voltage Vcc is varied.

Also, there has not occured a roll-off phenominum by the phase-compensating capacitor Cc and thus, the constant voltage supply circuit 1 can realize a high PSRR characteristic in a high frequency domain.

(3) If the gain of the output-controlling transistor MP1 is greatly reduced when the load of the load portion LOAD in low or no load condition, by rasing the gain of the MOS transistor MN4 cascode-connected in the operational amplifier 11, the gain of the feedback loop formed by the node nb, the phase-compensating capacitor Cc, the N-type MOS transistor MN4, the node na, and the P-type MOS transistor MP1 may be raised to obtain a sufficient phase margin.

(4) By provision of the phase-compensating capacitor Cc, even if the change of the output voltage Vout is occurred due to the rapid load change (variation), the high speed fluctuation component (signal Sc) is input to the sourse of the transistor MN4 in the cascode portion by the phase-compensating capacitor Cc, and the transistor MN4 operates as the gate grounded circuit, as a result, the feedback loop operates at a high speed. Accordingly, the transient response performance of the load change characteristic of the constant voltage supply circuit 1 is improved.

(5) The mirror capacitive value of the constance voltage supply circuit 1 shown in FIG. 6 is expressed by equation 4. Compared with the mirror capacitive value of the constant voltage supply circuit 1*f* shown in FIG. 2, by setting the trans-conductance $gm_1$ and the impedance $R_0$1 of the transistor MN4 large rather than the predetermined values, the constant voltage supply circuit showing the good PSRR frequency characteristic can be provided if the phase-compensating capacitor Cc having a small capacitance is used.

(6) The general constant voltage supply circuit becomes unstable when no load or low LOADL since the mirror capacitive value becomes small and the oscillation is occurred. However, in the constant voltage supply circuit 1 shown in FIG. 6, even if the output-compensating transistor MP1 may operate in the sub-threshold region, sufficient mirror capacitive value can be obtained by the high gain of the transistor MN4, and therefore, the stable frequency characteristic to the high frequency domain can be achieved. To realize such the characteristic, the constant voltage supply circuit 1 can be used without setting the minimum operation current.

(7) In the constant voltage supply circuit 1, the PSRR characteristic is free the provision of the phase-compensating capacitor Cc, and thus the good PSRR characteristic can be achieved in the high frequency domain. For example, the communication apparatuses such as the mobile telephones (cellular phones), the portable communication apparatus, etc. are burdened a strict PSRR characteristic. If the constant voltage supply circuit 1 shown in FIG. 6 is applied to such the communication apparatuses, the stable output voltage showing a good PSRR characteristic can be supplied.

(8) When the load portion LOAD, such as the communication circuits, illumination circuits, image processing circuits, data input output circuit or the like, is rapidly changed it load, in the constant voltage supply circuit 1 shown in FIG. 6, the transistor MN4 cascade-connected and functioning as the gate grounded circuit amplifies the signal S1 of the OTA in response to the variation component (signal $S_c$) of the output voltage through the high speed operation feedback loop including the phase-compensating capacitor $C_c$, to the transient regulation operation, and thus the load change (variation) characteristic is good.

(9) The constant voltage supply circuit 1 shown in FIG. 6 has the good load variation characteristic discussed above, and thus the capacitance value of the output capacitor C can be reduced. For example, if the constant voltage supply circuit 1 is applied as the power source for the communication apparatus such as cellular phone, portable communication apparatus, etc. the mounting space can be reduced, the capacitance value of the output capacitor C can be reduced, and the further cost reduction is achieved.

Fourth Embodiment

A fourth embodiment of a constant voltage supply circuit according to the present invention will be described with reference to FIG. 10.

Figure 10:
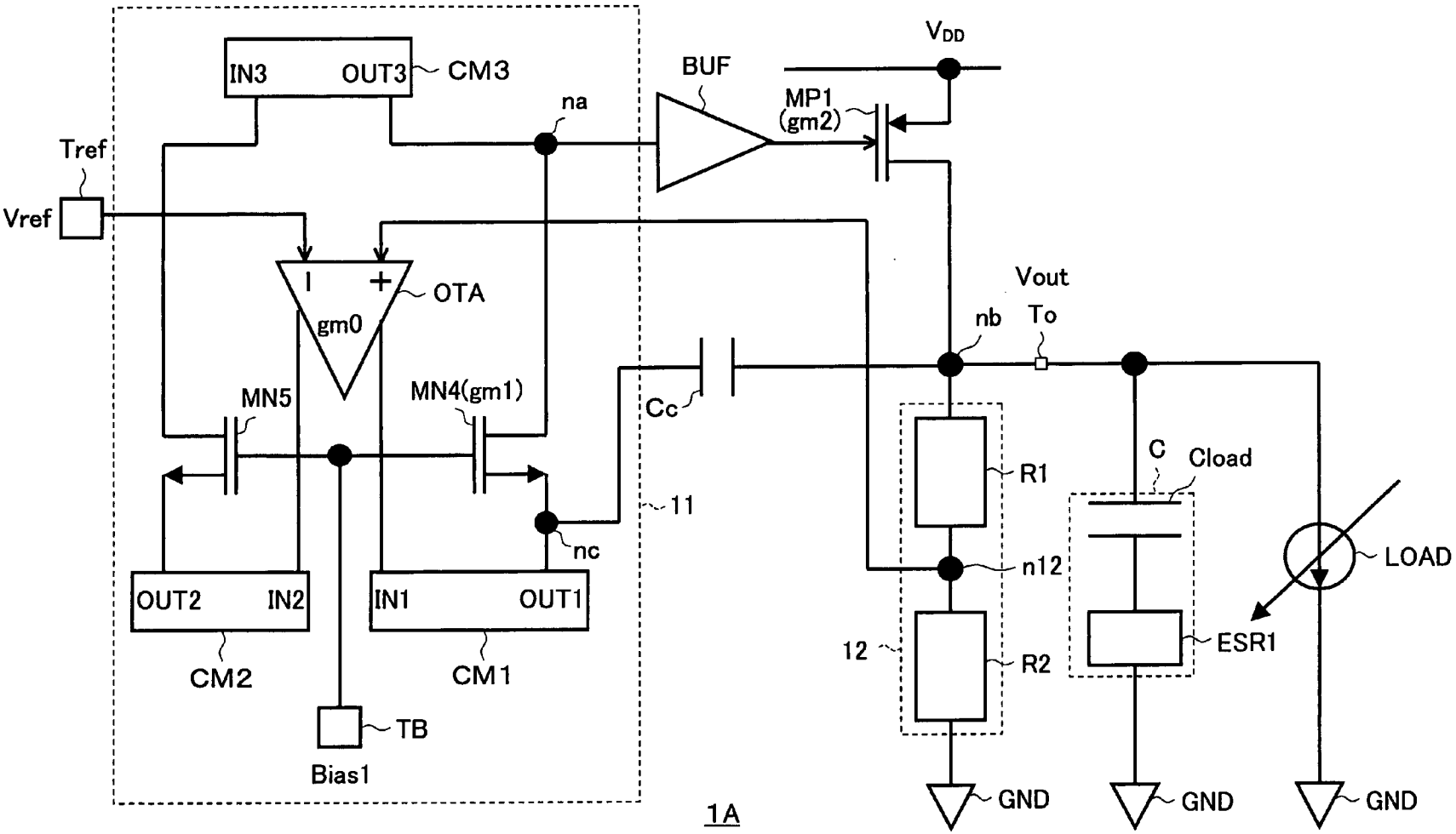
FIG. 10 is circuit diagram of a constant voltage supply circuit of a fourth embodiment.

The constant voltage supply circuit 1*a* of the fourth embodiment has an analog buffer circuit BUF provided between the node na and the gate of the output transistor MP1, as shown in FIG. 10. Other circuit components of the constant voltage supply circuit 1*a* are similar to those of the constant voltage supply circuit 1 shown in FIG. 6.

The analog buffer circuit BUF is formed as a source follower and operates at a high speed. The gain of the analog buffer circuit BUF is set at the frequency band higher than the frequency P2 of the second pole, represented in equation 2, for example. Thus, the provision of the analog buffer circuit BUF does not adversely affect the AC characteristics of the constant voltage supply circuit 1*a*. The analog buffer circuit BUF improves the drive ability of the output transistor MP1 to enable a high speed operation of the output transistor MP1, and the thereby further improve the output voltage variation characteristics to the constant voltage supply circuit 1 shown in FIG. 6. Further, the constant voltage supply circuit 1*a* improves the transient response characteristics to the constant voltage supply circuit 1, and thus the output capacitor Cload may be omitted or the capacitance value of the output capacitor Cload may be reduced.

Figure 11:
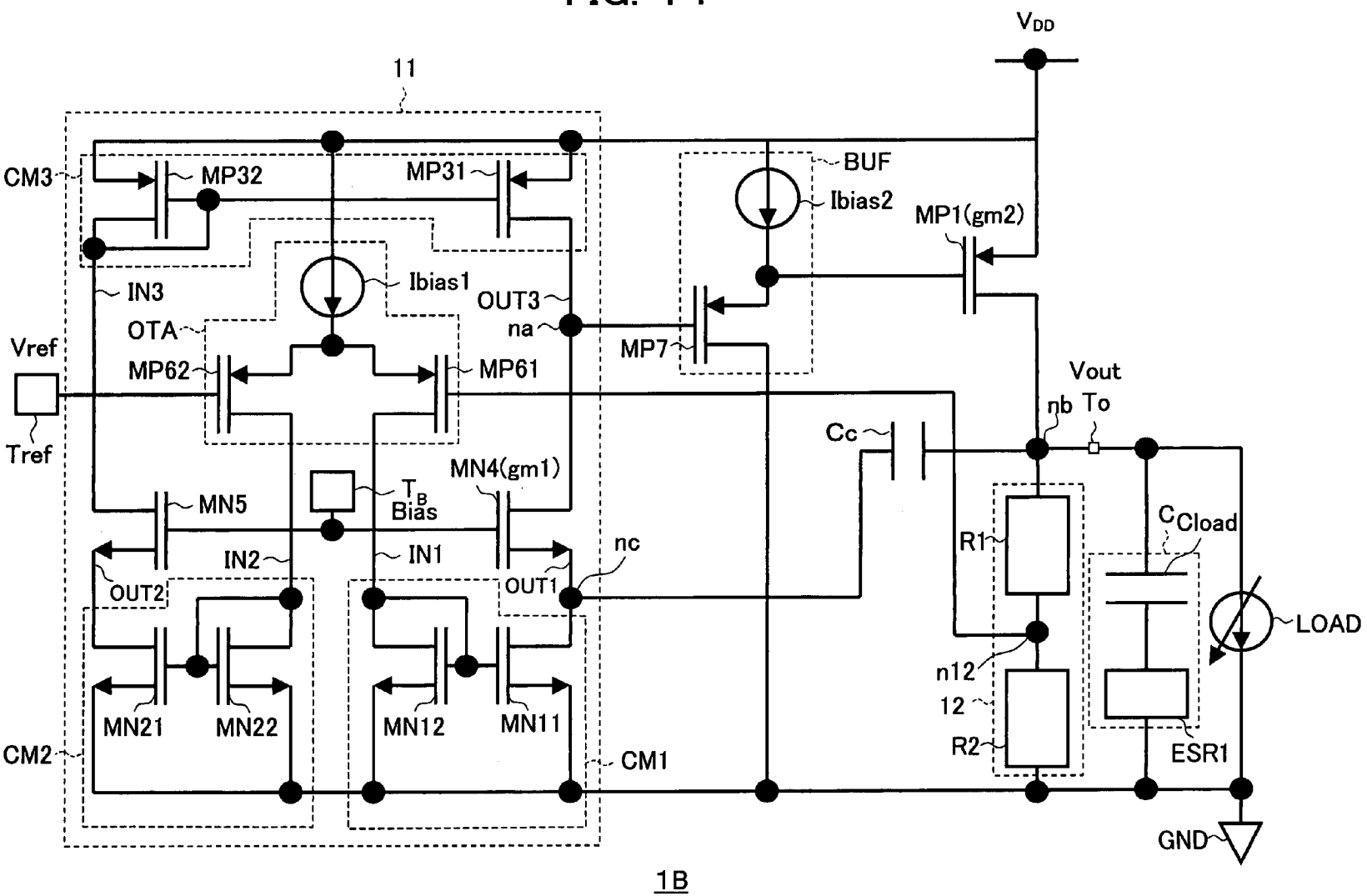
FIG. 11 is a specific circuit diagram of the constant voltage supply circuit shown in FIG. 10.

A specific circuit diagram of the fourth embodiment of the constant voltage supply circuit 1*a* shown in FIG. 10 is shown as in FIG. 11, as a constant voltage supply circuit 1*b*.

The current mirror circuit CM1 has N-type MOS transistors MN11 and MN12. Gates of the transistors MN11 and MN12 are commonly connected and are connected to a drain of the transistor MN12 and a drain of a P-type MOS transistor MP61 forming the OTA. Sources of the transistors MN11 and MN12 are commonly connected are connected to the standard potential portion GND. A drain of the transistor MN11 is connected to the one end of the phase-compensating capacitor $C_c$ and the source of the N-type transistor MN4.

The current mirror circuit CM2 has N-type MOS transistors MN21 and MN22. Gates of the transistors MN21 and MN22 are commonly connected, and connected to the drain of the transistor MN22 and a drain of a P-type MOS transistor MP62 forming the OTA. Sources of the transistors MN21 and MN22 are commonly connected to the standard potential portion GND. The drain of the transistor MN21 is connected to the source of the N-type MOS transistor MN5.

The current mirror circuit CM3 has P-type MOS transistors MP31 and MP32. Sources of the transistors MP31 and MP32 are commonly connected to the line of the power supply voltage $V_{DD}$. Gates of the transistors MP31 and MP32 are commonly connected to the drain of the transistor MP32. The drain of the transistor MP32 is connected to the drain of the transistor MN5. The drain of the transistor MP32 is connected to a gate of a transistor MP7 forming the analog buffer circuit BUF through the node na, and to the drain of the transistor MN4.

The circuit construction of the current mirror circuits CM1 to CM3 can be applied to those of the constant voltage supply circuit 1 shown in FIG. 6.

The operational trans-conductance amplifier (OTA) as the differential-operation type amplifier circuit has a differential operation pair consisting of the P-type MOS transistors MP61 and MP62, and a constant current source Ibias 1. The input terminal of the constant current source Ibias 1 is connected to the line of the power supply voltage $V_{DD}$ and the output terminal is connected to the sources of the transistors MP61 and MP62. The drain of the transistor MP61 is connected to the gate of the transistor MN12 forming the current mirror CM1. The drain of the transistor MP62 is connected to the gates of the transistors MN21 and MN21 forming the current mirror circuit CM2.

This circuit construction of the OTA can be applied to the OTA shown in FIG. 6.

The analog buffer circuit BUF has a constant current source Ibias 2 and the P-type MOS transistor constant MP7. The input terminal of the constant current source Ibias 2 is connected to the line of the power supply voltage $V_{DD}$ and the output terminal thereof is connected to the source of the P-type MOS transistor MP7 and the gate of the transistor MP1. The gate of the transistor MP7 is connected to the node na, and the drain thereof is connected to the standard potential point GND.

Fifth Embodiment

A fifth embodiment of a constant voltage supply circuit according to the present invention will be described with reference to FIG. 12.

Figure 12:
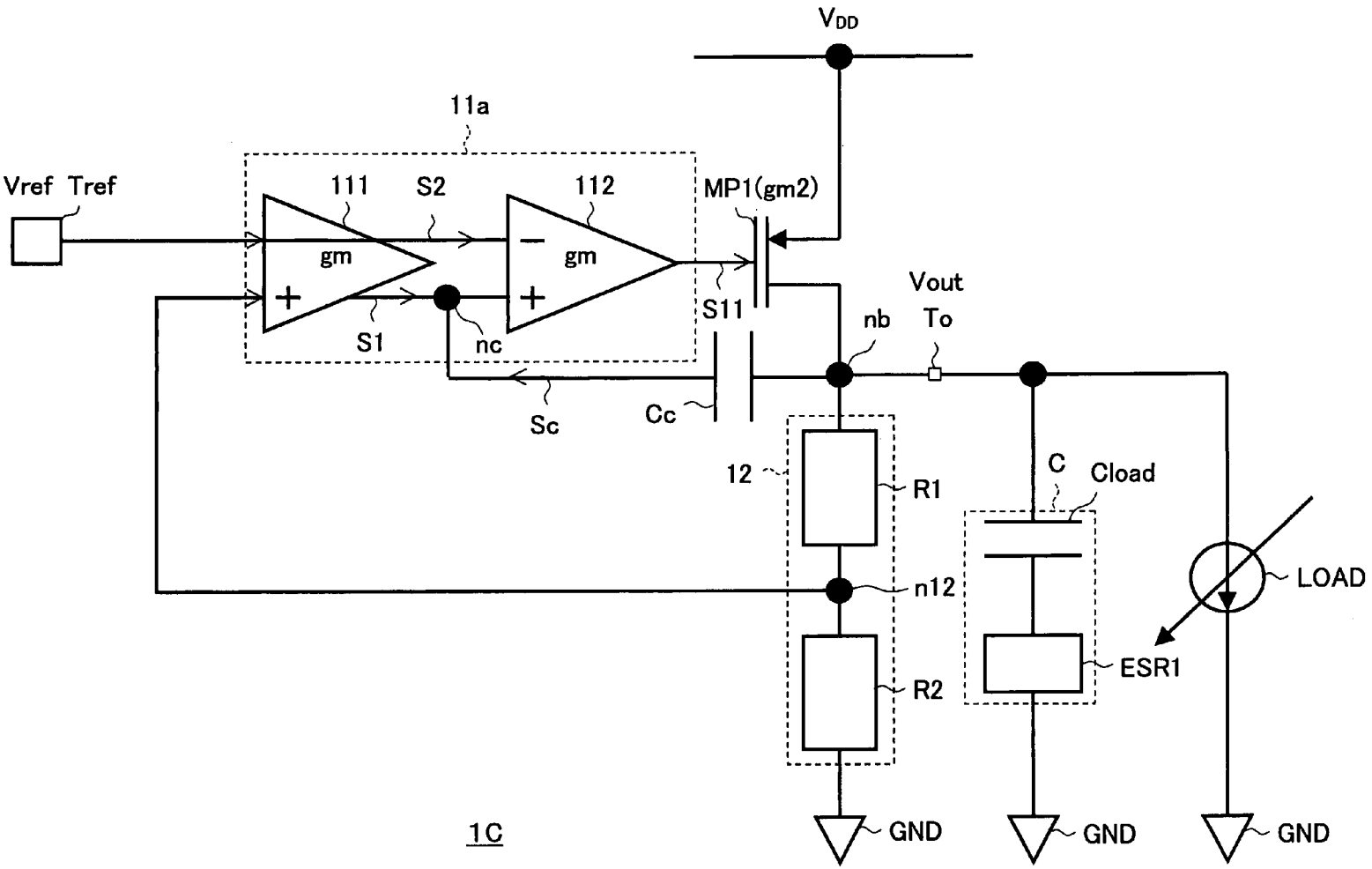
FIG. 12 is a circuit diagram of a constant voltage circuit of a fifth embodiment.

The constant voltage supply circuit 1*c* shown in FIG. 12 includes the P-type MOS FET transistor MP1, an operational amplifier circuit 11*a*, the voltage-dividing circuit 12, the phase-compensating capacitor $C_c$, and the smoothing capacitor C.

The operational amplifier circuit 11*a* includes a first amplifier circuit 111 and a second amplifier circuit 112.

The first amplifier circuit 111 generates the control signals S1 and S2 in response to the voltage difference between the reference voltage Vref supplied from the terminal Tref and the divided voltage which is divided the output voltage Vout of the output-controlling transistor MP1 by the voltage-dividing circuit 12. Namely, the first amplifier circuit 111 functions as the same of the OTA (operational trans-conductance amplifier) of the constant voltage supply circuits 1 and 1*a* shown in FIGS. 6 and 10.

The second amplifier circuit 112 generates the control signal S11 for eliminating the variation (fluctuation) component of the output voltage on the basis of the fluctuation components (signal Sc) of the output voltage of the output-controlling transistor MP1, input through the phase-compensating capacitor $C_c$, and outputs the same to the gate of the output-controlling transistor MP1. Apparently, the second amplifier circuit 112 functions as the same of the transistors MN4 and MN5, and the current mirror circuits CM1 to CM3 in the constant voltage supply circuits 1 and 1*a*, discussed above.

Many other modifications and/or alternatives can be adopted.

For example, the first amplifier circuit 111 may generate the control signal S1 in response to the voltage difference between the reference voltage Vref and the output voltage Vout from the output-controlling transistor MP1. The second amplifier circuit 112 amplifies the control signal S1 in response to the fluctuation components (signal Sc) of the output voltage the output-controlling transistor MP1, input through the phase-compensating capacitor $C_c$. The output-controlling transistor MP1 may generate the stable output voltage Vout on the basis of the control signal S1 generated at the first amplifier circuit 111 and the control signal S11 generated at the second amplifier circuit 112, and may output the resultant output voltage Vout to the output terminal $T_0$.

In the above constant voltage supply circuits of the preferred emodiments of the present invention, the provision of the feedback loop including the phase-compensating capacitor $C_c$ and the transistor MN4 or the second amplifier circuit 112 achieves the high performance and good transient response in a high frequency domain and the good PSRR characteristic in a high frequency domain. These are advantages to the series regulator power supply circuit disclosed in JP 2000-284843 or the like.

As discussed above, the constant voltage supply circuit according to the present invention provides a stable and constant output voltage regardless of the load change (variation or fluctuation). Accordingly, the constant voltage supply circuit of the present invention can be applied to a variety of electronic apparatuses, such as a portable communication apparatus, cellular phone, information processor, etc.

What is claimed is:

1. A constant voltage power supply circuit comprising:

a differential-operation type amplifier of which a first input terminal is supplied with a reference signal, and of which a second input terminal is supplied with a feedback signal, said amplifier outputting a first control signal responsive to a difference between the reference signal and the feedback signal;

an output transistor a output voltage detection circuit detecting an output voltage of the output transistor and applying a voltage corresponding to the detected voltage as the feedback signal to the second input terminal of the amplifier;

a first capacitor of which one end is connected to the output the output transistor; and a first control circuit, of which a first input terminal is connected to a first output terminal of the amplifier, of which a second input terminal is connected to another end of the first capacitor and of which an output terminal is connected to a control input terminal of the output transistor, said first control circuit generating a second control signal in response to the first control signal output from the amplifier and an output signal of the first capacitor and supplying the resultant second control signal to the control input terminal of the output transistor.

2. A constant voltage power supply circuit according to claim 1, further comprising a second control circuit, of which a first input terminal is connected to a second output terminal, and of which an output terminal is connected to the control input terminal of the output transistor, said second control circuit generating a third control signal in response to the first control signal and supplying the resultant third control signal to the control input terminal of the output transistor.

3. A constant voltage power supply circuit according to claim 1, further comprising a buffer circuit between the output terminal of the first control circuit and the control input terminal of the output transistor.

4. A constant voltage power supply circuit according to claim 1, further comprising a second capacitor for smoothing the output voltage of the output transistor.

5. A constant voltage power voltage supply circuit according to claim 1, wherein the differential-operation amplifier comprises first and second transistors which are connected to form a differential operation type pair circuit, a control input terminal of the first transistor is supplied with the reference voltage, a control input terminal of the second transistor is supplied with the feedback signal, and an output terminal of the first transistor is connected to the first input terminal of the first control circuit.

6. A constant voltage power supply circuit according to claim 1, wherein the output transistor comprises a P-type MOS transistor.

7. A constant power voltage supply circuit according to claim 1, wherein the first control circuit comprises a first current source circuit outputting a current having an amplitude corresponding to the first control signal output from the differential-operation type amplifier, and a first control transistor, of which a control input terminal is connected a transistor drive supply terminal, of which an input terminal is connected to the another end of the first capacitor and an output terminal of the first current source circuit, and of which an output terminal is connected to the control input terminal of the output transistor.

8. A constant voltage power supply circuit according to claim 7, wherein the first current source circuit comprises a current mirror circuit, and the first control transistor comprises an N-type MOS transistor.

9. A constant voltage power supply circuit according to claim 1, wherein the second control circuit comprises a second current source circuit outputting a current having an amplitude corresponding to the first control signal output from the differential-operation type amplifier, and a second control transistor, of which a control input terminal is connected a transistor drive supply terminal, of which an input terminal is connected to end the second current source circuit, and of which an output terminal is connected to the input terminal of the second current source circuit.

10. A constant voltage power supply circuit according to claim 9, wherein the second current source circuit comprises a current mirror circuit, and the second control transistor comprises an N-type MOS transistor.

11. A constant voltage power supply circuit comprising:

a P-type MOSFET output controlling transistor supplying a stable output voltage responsive to a first control signal;

an operational amplifier circuit generating the first control signal; and a phase-compensating capacitor, the operational amplifier circuit comprising a first amplifier circuit generating a second control in response to the voltage difference between a voltage corresponding to the output voltage of the output-controlling transistor and a reference voltage, and a second amplifier circuit providing the first control signal for eliminating a fluctuation component of the output voltage, in response to the second control signal generated at the first amplifier circuit, and a signal applied though the phase-compensating capacitor.

12. A constant voltage power supply circuit comprising:

a P-type MOSFET output-controlling transistor supplying a stable output voltage responsive to an input control signal;

a voltage-dividing circuit detecting the output voltage of the output-controlling transistor, and an amplifier circuit generating the first control signal; and a phase-compensating capacitor, the amplifier circuit comprising a first amplifier circuit generating a second control signal responsive to the voltage difference between a voltage corresponding to the output voltage detected at the voltage-dividing circuit and a reference, and a second amplifier cascade-connected to the first amplifier circuit, including a MOSFET, operating as a gate grounded circuit, generating the first control signal by amplifying the second control signal input from the first amplifier circuit on the basis of a fluctuation of the output voltage of the output-controlling transistors input through the phase-compensating capacitor for carrying out a mirror phase compensation, and inputting the first control signal to a gate of the outputting-controlling transistor.

13. A constant voltage power supply circuit according to claim 12, further comprising a buffer circuit buffering the first control signal output from the second amplifier circuit and inputting the same to the gate of the output-controlling transistor.

14. A constant voltage power supply circuit according to claim 12, wherein a mirror capacitance of said constant voltage supply circuit is proportional to the product of trans-conductance and output impedance of the output-controlling transistor, trans-conductance and output impedance of the second amplifier circuit, and a capacitance of the phase-compensating capacitor, and the trans-conductance and output impedance of the output-controlling transistor, the trans-conductance and output impedance of the second amplifier circuit and the capacitance of the phase compensating capacitor are set to exceed the mirror capacitance than a predetermined value to thereby obtain a phase margin when low load or no load.

* * * * *